US009182168B2

(12) United States Patent
Hernandez et al.

(10) Patent No.: US 9,182,168 B2
(45) Date of Patent: Nov. 10, 2015

(54) COMPARTMENTALIZED STORAGE CONTAINER

(75) Inventors: Francisco Hernandez, Cerritos, CA (US); Laura Ringemann, Aliso Viejo, CA (US)

(73) Assignee: BSH Home Appliances Corporation, Irvine, CA (US)

( * ) Notice: Subject to any disclaimer, the term of this patent is extended or adjusted under 35 U.S.C. 154(b) by 4 days.

(21) Appl. No.: 13/598,695

(22) Filed: Aug. 30, 2012

(65) Prior Publication Data

US 2014/0061201 A1 Mar. 6, 2014

(51) Int. Cl.
*F25D 25/02* (2006.01)
*F25D 23/06* (2006.01)

(52) U.S. Cl.
CPC ..... *F25D 25/025* (2013.01); *F25D 23/069* (2013.01); *F25D 2325/021* (2013.01); *F25D 2331/803* (2013.01); *Y10T 29/49826* (2015.01)

(58) Field of Classification Search
CPC ..... B65D 25/04; B65D 25/107; A47B 88/00; A47B 88/20; A47B 88/202; F25D 23/069; F25D 25/025
USPC ..... 62/326, 328–329, 383, 440, 442, 446, 62/465, 441, 447; 220/528–529, 540, 220/543–546, 549, 553–554, 500, 530, 220/532–533, 551; 312/348.3, 401, 404, 312/405.1, 407, 294, 330.1
See application file for complete search history.

(56) References Cited

U.S. PATENT DOCUMENTS

| | | | | | |
|---|---|---|---|---|---|
| 1,523,136 | A | * | 1/1925 | O'Connor | 220/533 |
| 2,586,925 | A | * | 2/1952 | Drengberg | 220/533 |
| 2,627,993 | A | * | 2/1953 | Hafner | 220/533 |
| 2,897,997 | A | * | 8/1959 | Sitler | 220/533 |
| 2,985,333 | A | * | 5/1961 | Kirkman | 220/533 |
| 3,117,688 | A | * | 1/1964 | Walstad et al. | 217/7 |
| 3,807,572 | A | * | 4/1974 | Luvara et al. | 312/108 |
| 4,372,444 | A | * | 2/1983 | Le Grand et al. | 220/532 |
| 4,577,773 | A | * | 3/1986 | Bitel | 220/533 |
| 4,728,158 | A | * | 3/1988 | D'Elia et al. | 312/108 |
| RE32,740 | E | * | 8/1988 | Steffes | 312/351 |
| 4,964,528 | A | * | 10/1990 | Wagoner | 220/551 |
| 5,082,139 | A | * | 1/1992 | Quam | 220/530 |
| 5,219,216 | A | * | 6/1993 | Hassel et al. | 312/9.54 |
| 5,242,223 | A | * | 9/1993 | Koves | 312/348.3 |
| 5,269,600 | A | * | 12/1993 | Arreola et al. | 220/542 |
| 5,433,336 | A | * | 7/1995 | Kristoffersson | 220/531 |
| 5,603,559 | A | * | 2/1997 | Yemini | 220/533 |

(Continued)

OTHER PUBLICATIONS

Sub-Zero, Sub-Zero Pro 48 Refrigerator, Sub-Zero-Wolf.com, May 2011, p. 8.

(Continued)

*Primary Examiner* — Bryon Gehman
*Assistant Examiner* — Brijesh V. Patel
(74) *Attorney, Agent, or Firm* — James E. Howard; Andre Pallapies

(57) ABSTRACT

A system for dividing a container into compartments has a divider that divides the container into compartments. The system also has a first support device configured to removably receive and support the divider in a first orientation that forms laterally adjacent compartments and a second support device configured to removably receive and support the divider in a second orientation that forms vertically adjacent compartments. The divider is received by either the first or second support device.

52 Claims, 8 Drawing Sheets

(56) References Cited

U.S. PATENT DOCUMENTS

| | | | | |
|---|---|---|---|---|
| 5,992,959 | A * | 11/1999 | Kawamoto | 312/348.3 |
| 6,039,202 | A * | 3/2000 | Olstad et al. | 220/533 |
| 6,138,858 | A * | 10/2000 | Tu | 220/529 |
| 6,231,099 | B1 * | 5/2001 | Greenwald | 296/37.8 |
| 6,619,773 | B2 * | 9/2003 | Amsterdam | 312/348.3 |
| 6,811,232 | B2 * | 11/2004 | Doan et al. | 312/291 |
| 6,880,903 | B2 | 4/2005 | O'Halloran et al. | |
| 6,996,450 | B2 * | 2/2006 | Suttile et al. | 700/121 |
| 7,004,323 | B1 * | 2/2006 | Symonds | 220/533 |
| 7,296,433 | B2 | 11/2007 | Uihlein et al. | |
| 7,334,684 | B1 * | 2/2008 | Fontanilla et al. | 206/541 |
| 7,475,562 | B2 | 1/2009 | Jackovin | |
| 7,703,866 | B2 | 4/2010 | Benz et al. | |
| 2005/0236946 | A1 * | 10/2005 | LeClear et al. | 312/348.3 |
| 2005/0236947 | A1 * | 10/2005 | LeClear et al. | 312/404 |
| 2006/0250062 | A1 * | 11/2006 | Janda et al. | 312/402 |
| 2007/0052331 | A1 * | 3/2007 | Newman | 312/194 |
| 2007/0084234 | A1 * | 4/2007 | Park et al. | 62/407 |
| 2007/0108685 | A1 * | 5/2007 | Casale et al. | 269/289 R |
| 2007/0120452 | A1 * | 5/2007 | Benz et al. | 312/400 |
| 2007/0151281 | A1 * | 7/2007 | Jackovin | 62/344 |
| 2007/0228907 | A1 | 10/2007 | Luisi et al. | |
| 2008/0128428 | A1 * | 6/2008 | Beckerman | 220/532 |
| 2008/0272679 | A1 * | 11/2008 | Wuesthoff et al. | 312/404 |
| 2009/0026906 | A1 * | 1/2009 | Kim | 312/401 |
| 2010/0192621 | A1 * | 8/2010 | Kim | 62/441 |
| 2010/0295435 | A1 * | 11/2010 | Kendall et al. | 312/401 |
| 2010/0319391 | A1 * | 12/2010 | Lim et al. | 62/441 |
| 2011/0174012 | A1 * | 7/2011 | Park | 62/449 |
| 2011/0252817 | A1 * | 10/2011 | Tunzi | 62/89 |
| 2011/0259036 | A1 * | 10/2011 | Lim et al. | 62/344 |
| 2012/0181910 | A1 * | 7/2012 | Kim | 312/404 |
| 2012/0319550 | A1 * | 12/2012 | Manniso et al. | 312/348.3 |

OTHER PUBLICATIONS

Frigidaire, New Frigidaire Upright Freezer Features, CurrentLmNetwork.com, 2009, p. 3.

Haier, Built-in Under Counter Dual Drawer Refrigeratoe/DD300RW, HaierAmerica.com, 2010, p. 6.

General Electric Co., ZDI240 Double-Drawer Built-In Refrigerator, GEAppliances.com, Aug. 2007, p. 9-10.

* cited by examiner

COMPARTMENTALIZED STORAGE CONTAINER

FIELD OF THE TECHNOLOGY

The present technology relates to a compartmentalized storage container, in particular to a storage container for a kitchen appliance.

BACKGROUND OF THE TECHNOLOGY

Several types of kitchen appliances include storage systems such as drawers to store objects. Some storage systems include dividers that divide the drawer into laterally adjacent compartments. However, the space within the drawer could be more efficiently utilized if the drawer were also divided into compartments that are stacked on top of each other. In addition, utilizing interchangeable dividers that could be used to create laterally adjacent compartments and vertically adjacent compartments would increase the flexibility of the storage system.

SUMMARY OF THE TECHNOLOGY

One aspect of the disclosed technology is a divider for dividing a container into compartments. The divider is configured to form vertically adjacent compartments and/or laterally adjacent compartments. In addition, the divider may be interchangeable with other dividers.

Another aspect of the disclosed technology is a divider for dividing a container into compartments. The divider is configured to form vertically adjacent compartments and laterally adjacent compartments and has tongues at both ends.

Another aspect of the disclosed technology is a divider for dividing a container into compartments. The divider is configured to form vertically adjacent compartments and laterally adjacent compartments and has one or more grooves configured to receive an upper edge of another divider.

Another aspect of the disclosed technology is a container having first and second support devices that facilitate forming vertically and horizontally adjacent compartments.

Another aspect of the disclosed technology is a system for dividing a container into compartments. The system includes a divider that divides the container into compartments. The system also includes a first support device configured to removably receive and support the divider in a first orientation that forms laterally adjacent compartments and a second support device configured to removably receive and support the divider in a second orientation that forms vertically adjacent compartments. The divider is received by either the first or second support device.

Another aspect of the disclosed technology is a system for dividing a container into compartments. The system includes a divider that divides the container into compartments. The system also includes a first support device configured to removably receive and support the divider in a first orientation that forms laterally adjacent compartments. The divider is a second support device configured to removably receive and support another divider in a second orientation that forms vertically adjacent compartments.

Another aspect of the disclosed technology is a system for dividing a container into compartments. The system includes a divider that divides the container into compartments. The system also includes a first support device configured to removably receive and support the divider in a first orientation that forms laterally adjacent compartments. The divider is a second support device configured to removably receive and support another divider in a second orientation that forms vertically adjacent compartments. Both dividers are interchangeable.

Another aspect of the disclosed technology is a method for dividing a container into compartments. The method includes forming laterally adjacent compartments by inserting a first divider into a first support device. The method also includes forming vertically adjacent compartments by placing the first divider or a second divider on a second support device. The first and second dividers are interchangeable.

Another aspect of the disclosed technology is a kitchen appliance. The kitchen appliance includes a container and a divider that divides the container into compartments. The kitchen appliance also includes a support device configured to removably receive and support the divider in a first orientation that forms laterally adjacent compartments and a second support device configured to removably receive and support the divider in a second orientation that forms vertically adjacent compartments. The divider is received by either the first or second support device.

The above aspects of the disclosed technology increase the versatility of an organization system utilizing a limited number of components.

Other aspects, features, and advantages of this technology will become apparent from the following detailed description when taken in conjunction with the accompanying drawings, which are a part of this disclosure and which illustrate, by way of example, principles of this technology.

BRIEF DESCRIPTION OF THE DRAWINGS

The accompanying drawings facilitate an understanding of the various examples of this technology. In such drawings.

DETAILED DESCRIPTION OF ILLUSTRATED EXAMPLES

The following description is provided in relation to several examples which may share common characteristics and features. It is to be understood that one or more features of any one example may be combinable with one or more features of the other examples. In addition, any single feature or combination of features in any of the examples may constitute additional examples.

Figure 1:
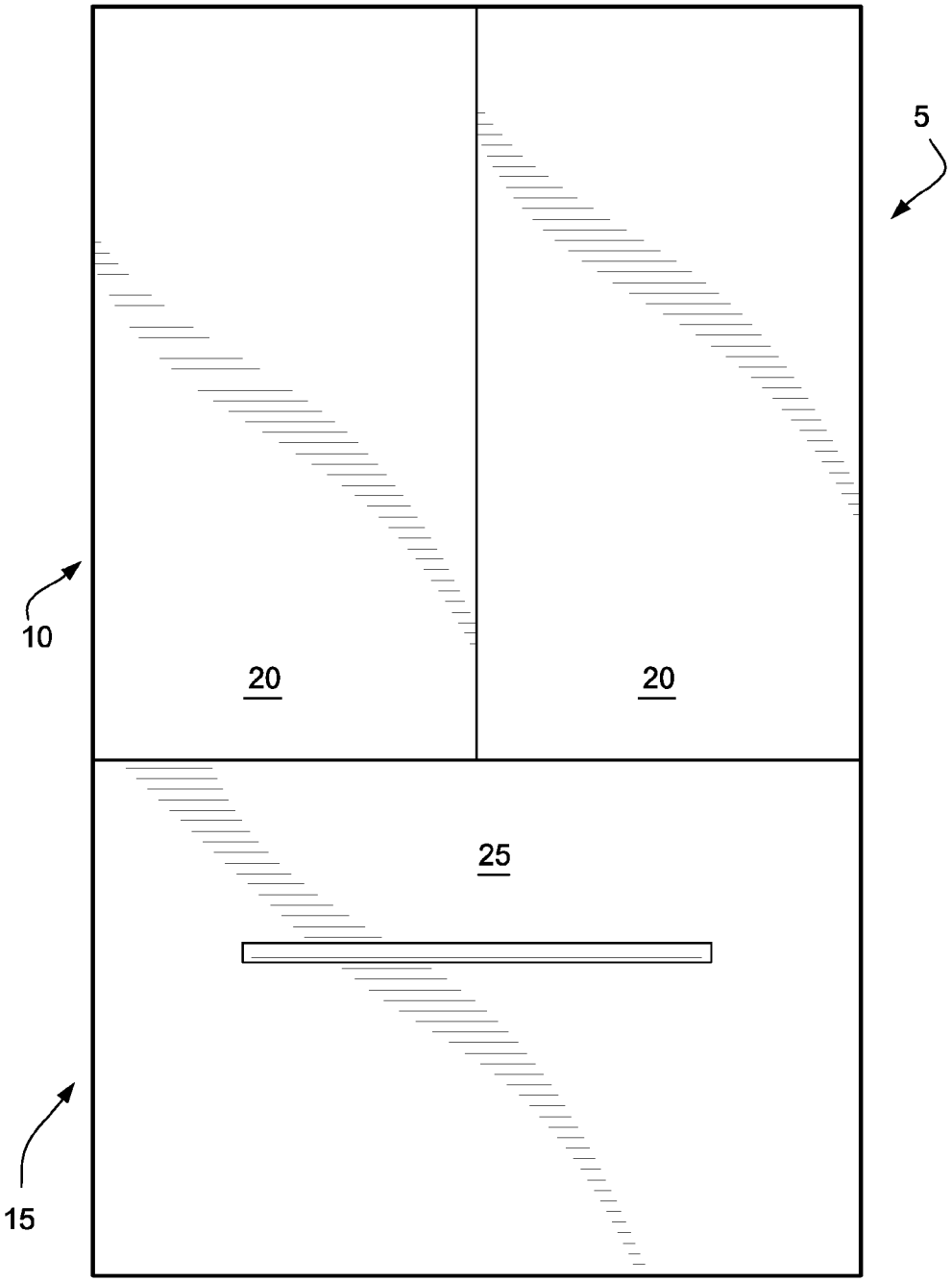
FIG. 1 is an illustration of a kitchen appliance according to an example of the present technology.

FIG. 1 illustrates an exemplary kitchen appliance 5. The kitchen appliance 5 may be, for example, a combined refrigerator and freezer for storing perishable products at cold temperatures. The kitchen appliance 5 may include a refrigerator portion 10 and a freezer portion 15. An interior of the refrigerator portion 10 may be accessed by opening doors 20, while an interior of the freezer portion 15 may be accessed by opening a slidable container 25. The container 25 may store the perishable products to be stored in the freezer portion 15. Although the container 25 is illustrated as being associated with the freezer portion 15, the container 25 may be associated with the refrigerator portion 10 (i.e., provide storage for the perishable products to be refrigerated). In addition to kitchen appliances, the container 25 may be associated with shelving and/or furniture systems such as, for example, cabinetry, hutches, chests, cupboards, wall units, etc. Furthermore, in addition to a slidable container (drawer), the container 25 may be any type of device capable of storing objects such as for example, a bin, chest, crate, trunk, etc.

Figure 2:
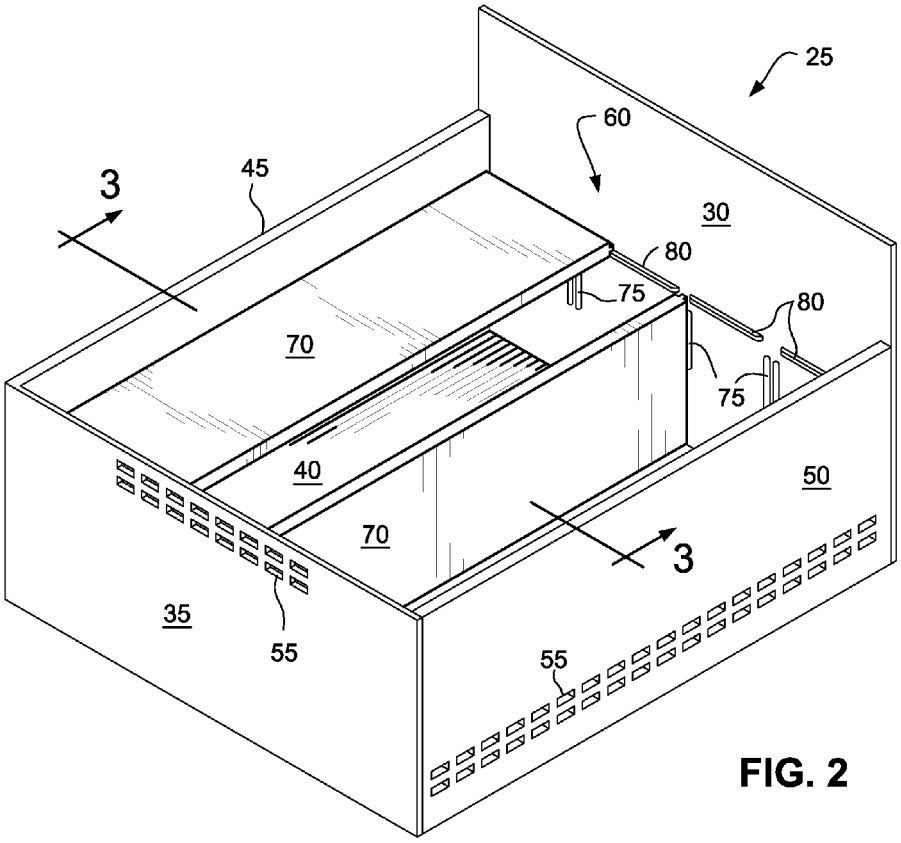
FIG. 2 is a perspective view of an exemplary compartmentalized container for use with the kitchen appliance of FIG. 1.
Figure 3:
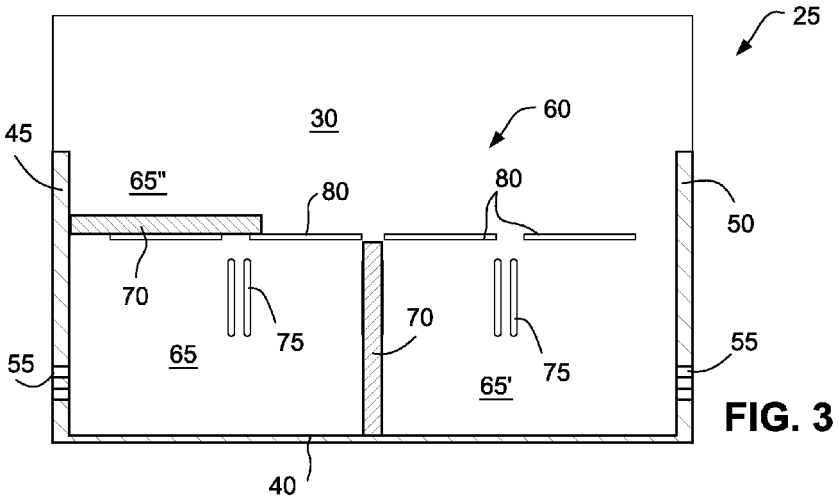
FIG. 3 is a cross-sectional view taken along line 3-3 of FIG. 2.

FIGS. 2 and 3 illustrate an exemplary container 25 having a front wall 30, a rear wall 35, a bottom wall 40 and side walls 45, 50. Although the container 25 illustrated in FIGS. 2 and 3 does not include a lid, the container 25 may include a removable or pivotable lid. The side walls 45, 50 and rear wall 35 may include vent holes 55 to permit the circulation of air through the container 25. In addition, the container 25 may include an organization system 60 for dividing an interior of the container 25 into a plurality of compartments 65. The organization system 60 may include dividers 70, vertical support devices 75 and/or horizontal support devices 80.

Figure 4:
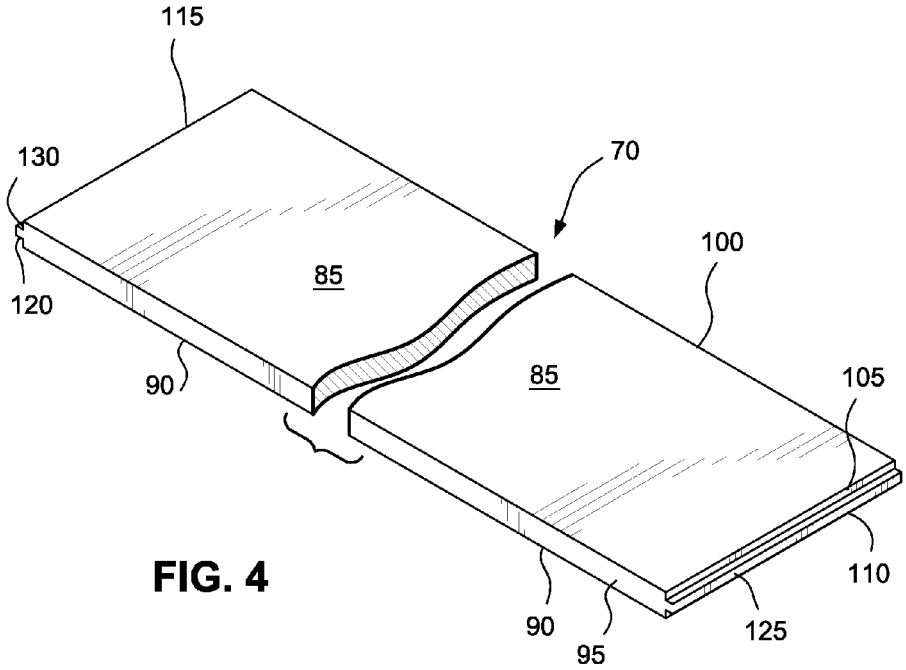
FIG. 4 is perspective view of an exemplary divider used in the compartmentalized container of FIGS. 2 and 3.

As illustrated in FIG. 4, each divider 70 may be a thin, flat panel that may act as a wall between two compartments 65. Each divider 70 may include a first face 85 opposing a second face 90. Side faces 95 and 100 may oppose each other and may extend from the first face 85 to the second face 90. Each divider 70 may also include a first end 105 terminating at a first tongue 110 and a second end 115 terminating at a second tongue 120. The first and second tongues 115, 120 may interact with the vertical support devices 75 and/or the horizontal support devices 80 to support the divider 70 in the container 25.

The first and second tongues 110, 120 may extend any distance up to the entire width of the divider 70 and may be thinner than the divider 70. In addition, a distance between a distal end 125 of the first tongue 110 and a distal end 130 of the second tongue 120 may be the same as a distance between the side walls 45, 50 and/or a distance between the front wall 30 and the rear wall 35 (or a distance between recesses on opposing walls). Alternatively, the first and second tongues 110, 120 may be omitted from the dividers 70, and the first and second ends 105, 115 themselves may interact with the vertical support devices 75 and the horizontal support devices 80. In this configuration, a distance between the first and second ends 105, 115 may be the same as the distance between the side walls 45, 50 and/or the distance between the front wall 30 and the rear wall 35. In addition, the dividers 70 may be formed from any material such as, for example, extruded aluminum, plastic, etc. In addition, the dividers 70 may have an anodized finish.

Figure 5:
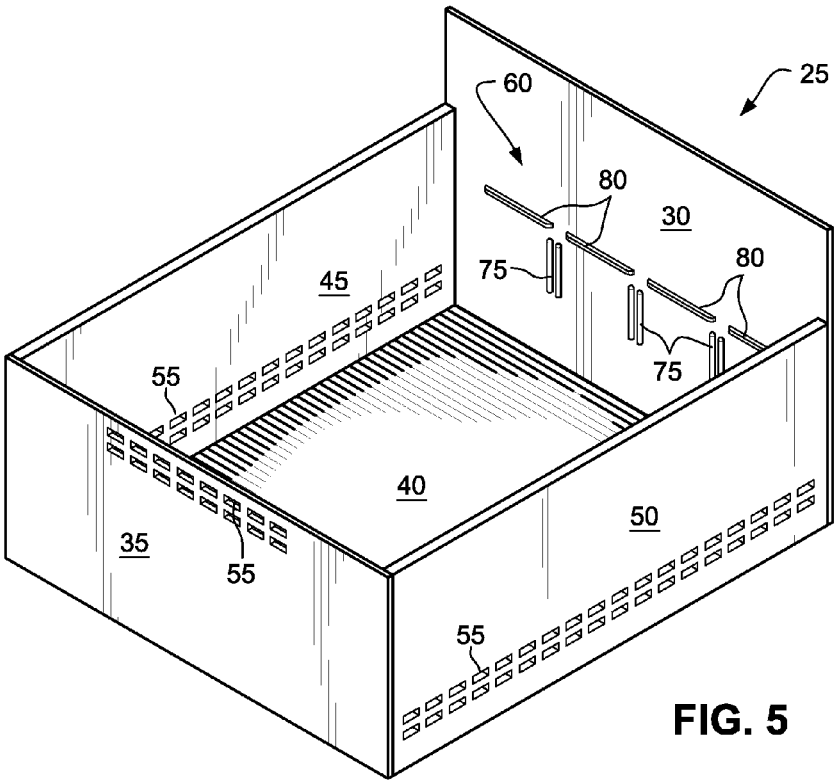
FIG. 5 is s rear perspective view of the container of FIGS. 2 and 3 shown without any dividers.
Figure 6:
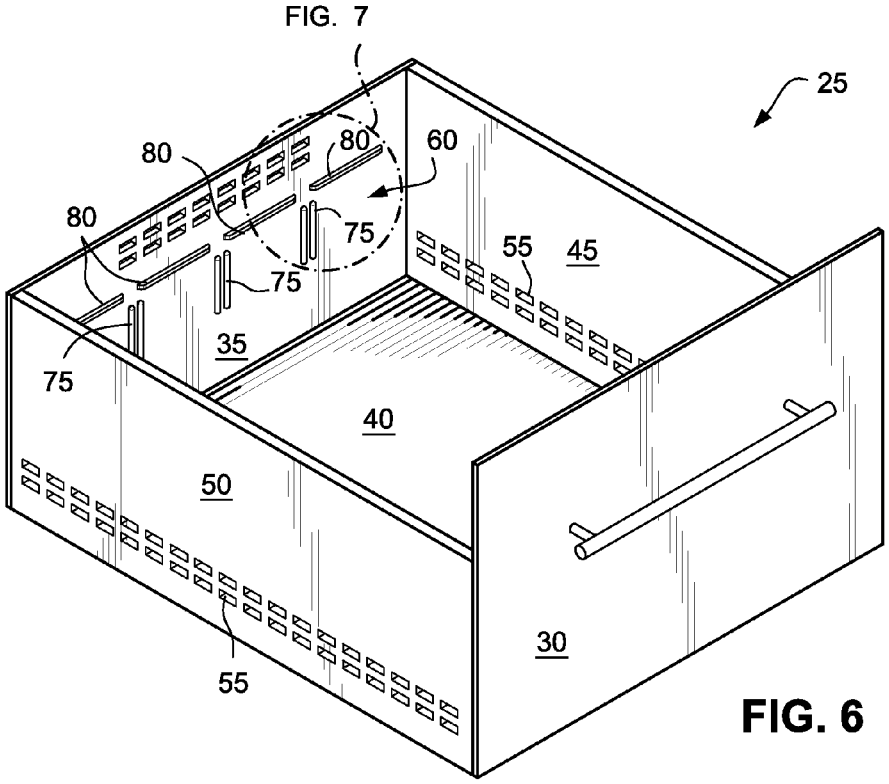
FIG. 6 is a front perspective view of the container of FIGS. 2 and 3 shown without any dividers.

As illustrated in FIGS. 5 and 6, each vertical support device 75 may be paired with another vertical support device 75 attached to an opposing wall to receive and support a divider 70 in an upright orientation. In the upright orientation, the divider 70 may form laterally adjacent compartments 65 and 65'. In addition, each horizontal support device 80 may be paired with another horizontal support device 80 attached to an opposing wall to receive and support a divider 70 in a horizontal orientation. In the horizontal orientation, the divider 70 may form vertically adjacent compartments 65 and 65".

Figure 7:
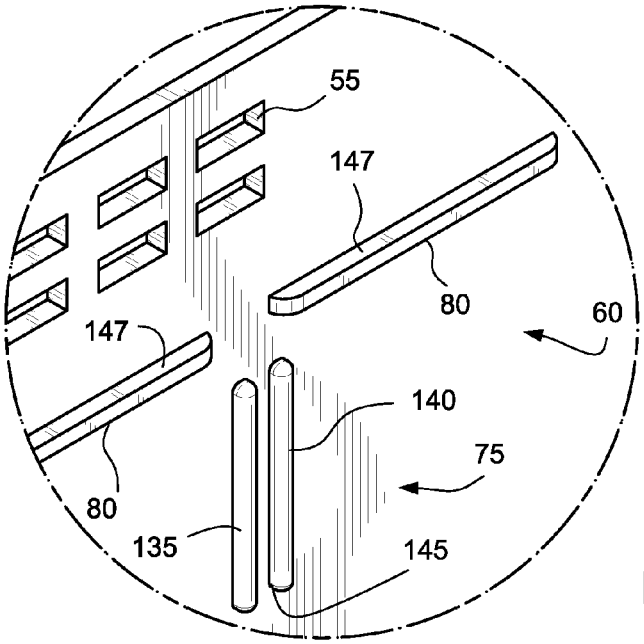
FIG. 7 is an enlarged detail view taken from FIG. 6.

As illustrated in FIGS. 5-7, each vertical support device 75 may include a first guide 135, a second guide 140 and a receiving space 145. The first and second guides 135, 140 may be protrusions capable of guiding one of the first and second tongues 110, 120 (or one of the first and second ends 105, 115 if the first and second tongues 110, 120 are omitted) of a particular divider 70 toward the receiving space 145. In addition to guiding the divider 70 toward the receiving space 145, the first and second guides 135, 140 may support and maintain the divider 70 in an upright orientation in which the side face 95 or the side face 100 abuts the bottom wall 40.

The first and second guides 135, 140 may be integral to the wall on which they are located. Alternatively, the first and second guides 135, 140 may be formed separately from the container 25 and may be permanently or removably attached to a particular wall. In configurations utilizing removably attachable vertical support devices 75, the vertical support devices 75 may not be limited to a single location. Thus, utilizing removably attachable vertical support devices 75 may increase the number of potential configurations of the organization system 60, thereby increasing the flexibility of the orientation system 60.

FIGS. 5-7 illustrate the first and second guides 135, 140 as having rounded surfaces, which may help facilitate directing the divider 70 toward the receiving space 145. However, the first and second guides 135, 140 may have any shape such as, for example, a rectangular shape or a triangular shape.

The receiving space 145 may be a flat portion of a surface of the wall that is between the first and second guides 135, 140. Alternatively, the receiving space 145 may be a recess extending a distance that may be between a length of the first and second tongues 110, 120 (or first and second ends 105, 115) to a height of the wall in which the recess is located. For vertical support devices 75 utilizing recessed receiving spaces 145, the first and second guides 135, 140 may be included or may be omitted. In addition, for embodiments in which the recessed receiving space 145 does not extend the entire height of the wall to which the vertical support device 75 is attached, the removability of the divider 70 may be maintained by forming the divider 70 from flexible material that may be warped during insertion and removal from the vertical support devices 75. Otherwise, the divider 70 may be made from rigid materials that resist warping and may be permanently secured to the vertical support device 75.

A distance between the first and second guides 135, 140 (which may correspond to a width of the receiving space 145) may be sized to be slightly larger than the thickness of the first and second tongues 110, 120 (or slightly larger than the thickness of the first and second ends 105, 115) so that the receiving space 145 may easily receive the first and second tongues 110, 120 (or the first and second ends 105, 115). However, the width of the receiving space 145 must be small enough so that movement of the divider 70 within the receiving space 145 may be minimized.

A combined recess depth of the receiving space 145 and protrusion distance of the first and second guides 135, 140 may be large enough to retain the first and second tongues 110, 120 (or the first and second ends 105, 115) within the vertical support device 75. Accordingly, a depth of a recessed receiving space 145 of a vertical support device 75 without the first and second guides 135, 140 may be the same as a protrusion distance of the first and second guides 135, 140 of a vertical support device 75 in which the receiving space 145 is not recessed. However, for vertical support devices 75 that include the first and second guides 135, 140 and the recessed receiving space 145, the recess depth and the protrusion distance may be the same or may be different as long as the combined recess depth and protrusion distance is large enough to retain the first and second tongues 110, 120 (or the first and second ends 105, 115) within the vertical support device 75.

A length of each vertical support device 75 may be long enough to support and maintain the divider 70 in the upright orientation. In addition, the first and second guides 135, 140 may be any length and positioned at any height within the container 25. However, any portion of the first and second guides 135, 140 positioned at a height above the horizontal support devices 80 may interfere with the positioning of dividers 70 on the horizontal support devices 80 and/or a shifting of dividers 70 from one horizontal support device 80 to another horizontal support device 80.

Each vertical support device 75 may be aligned with an opposing vertical support device 75 so that both vertical support devices 75 are positioned at corresponding locations on their respective walls. In addition, the organization system 60 may utilize any type of vertical support device 75 (i.e., vertical support devices 75 that utilize the first and second guides 135, 140 without a recessed receiving spaces 145, vertical support devices 75 that utilize the first and second guides 135, 140 with recessed receiving spaces 145 and vertical support devices 75 that utilize recessed receiving spaces 145 without the first and second guides 135, 140).

Each horizontal support device 80 may include a protrusion 147 having a planar upper surface on which the first and second tongues 110, 120 (or the first and second ends 105, 115) may rest and/or a recess in which the first and second tongues 110, 120 (or the first and second ends 105, 115) may be inserted. Just as in the case of the vertical support devices 75, the organization system 60 may utilize any type of horizontal support devices 80 (i.e., horizontal support devices 80 that include only the protrusions 147, horizontal support devices 80 that include only recesses and horizontal support devices 80 that include both protrusions 147 and recesses). For horizontal support devices 80 that include both protrusions 147 and recesses, the recess may be located above the protrusion 147 so that the distal ends 125, 130 may be inserted in the recesses and the remaining portions of the first and second tongues 110, 120 (or the first and second ends 105, 115) may rest on the protrusions 147.

Similar to the first and second guides 135, 140, the protrusions 147 may be integral to the wall on which they are located or may be formed separately from the container 25. If formed separately from the container 25, the protrusions 147 may be permanently or removably attached to a particular wall. In configurations utilizing removably attachable protrusions 147, the horizontal support devices 80 may not be limited to a single location. Thus, utilizing removably attachable protrusions 147 may increase the number of potential configurations of the organization system 60, thereby increasing the flexibility of the orientation system 60.

FIGS. 5-7 illustrate the protrusions 147 as having rectangular shapes. However, the protrusions 147 may have any shape that has a planar upper surface upon which the first and second tongues 110, 120 (or the first and second ends 105, 115) may rest.

A combined recess depth of the recesses and protrusion distance of the protrusions 147 may be large enough to prevent the divider 70 from slipping off the horizontal support device 80. Accordingly, a depth of a recess of a horizontal support device 80 without the protrusion 147 may be the same as a protrusion distance of the protrusion 147 of a horizontal support device 80 without a recess. However, for horizontal support devices 80 that include both protrusions 147 and recesses, the recess depth and the protrusion distance may be the same or may be different as long as the combined recess depth and protrusion distance is large enough to prevent the divider 70 from slipping off the horizontal support device 80.

In addition, a length of each horizontal support device 80 may be long enough to prevent the divider 70 from slipping off the horizontal support device 80. For example, the horizontal support device 80 may extend the entire length of an associated wall. In a configuration with multiple horizontal support devices 80 on a single wall, the horizontal support devices 80 may be spaced close enough together so that more than one horizontal support device 80 supports the divider 70 at the same time. In this configuration, a divider may slide off of one horizontal support device 80 without the divider 70 falling between horizontal support devices 80. However, horizontal support devices 80 that include protrusions 147 should not be positioned directly above a vertical support device 75 to avoid interfering with the installation and/or removal of a vertically oriented divider 75.

All of the horizontal support devices 80 may be positioned at the same height or at different heights. It should be understood that if the dividers 70 are to be supported by multiple horizontal support devices 80, the horizontal support devices 80 should be positioned at the same height. The horizontal support devices 80 may be configured so that multiple horizontal support devices 80 may be positioned at a particular height, while other horizontal support devices 80 may be positioned at different heights. In addition the horizontal support devices 80 should be positioned at least as high as a height of the dividers 70 that are vertically oriented so that the horizontally oriented dividers 70 do not interfere with the vertically oriented dividers 70.

Similar to the vertical support devices 75, each horizontal support device 80 may be aligned with an opposing horizontal support device 80 so that both horizontal support devices 80 are positioned at corresponding locations on their respective walls. In addition, each pair of horizontal support devices 80 may utilize only a single type of horizontal support device 80 (i.e., only recessed horizontal support devices 80 without protrusions 147, only horizontal support devices 80 with protrusions 147 and without recesses or only horizontal support devices 80 with both protrusions 147 ands recesses). Alternatively, each pair may utilize multiple types of horizontal support devices 80. For pairs that utilize opposing recessed horizontal support devices 80, the removability of the divider 70 may be maintained by forming the divider 70 from flexible material that may be warped during insertion and removal from the horizontal support devices 80. Alternatively, the divider 70 may be made from rigid material that resists warping.

FIGS. 5-7 illustrate an exemplary configuration in which the vertical support devices 75 and the horizontal support devices 80 are attached to the front wall 30 and the rear wall 35. Alternatively, the vertical support devices 75 and the horizontal support devices 80 may be attached to the side walls 45, 50 in addition to, or instead of, the front wall 30 and the rear wall 35.

In one configuration that utilizes all of the walls of the container 25, each wall may have a combination of vertical support devices 75 and horizontal support devices 80. In another configuration utilizing all of the walls of the container 25, the vertical support devices 75 may be located on one set of opposing walls (e.g., the side walls 45 and 50 or the front wall 30 and the rear wall 35), while the horizontal support devices 80 may be located on the other set of opposing walls. In this configuration, a single protrusion 147 extending the length of a corresponding wall would not interfere with the removability and/or installation of a vertically oriented divider 70.

Figure 8:
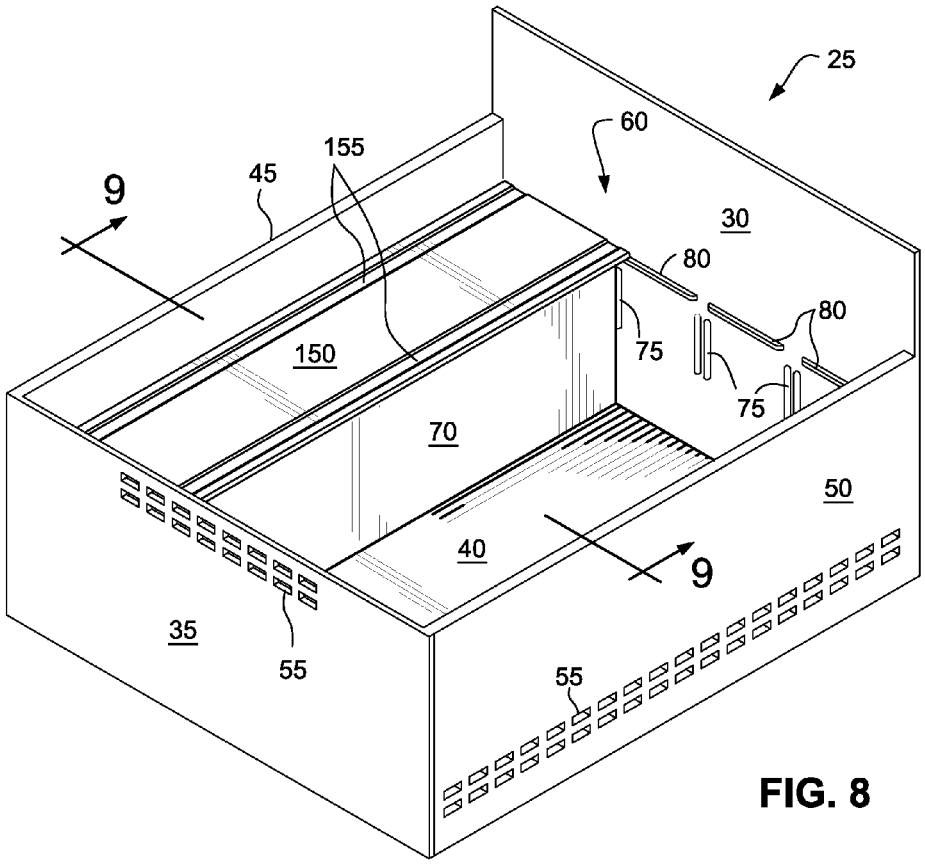
FIG. 8 is another exemplary compartmentalized container for use with the exemplary kitchen appliance of FIG. 1.
Figure 9:
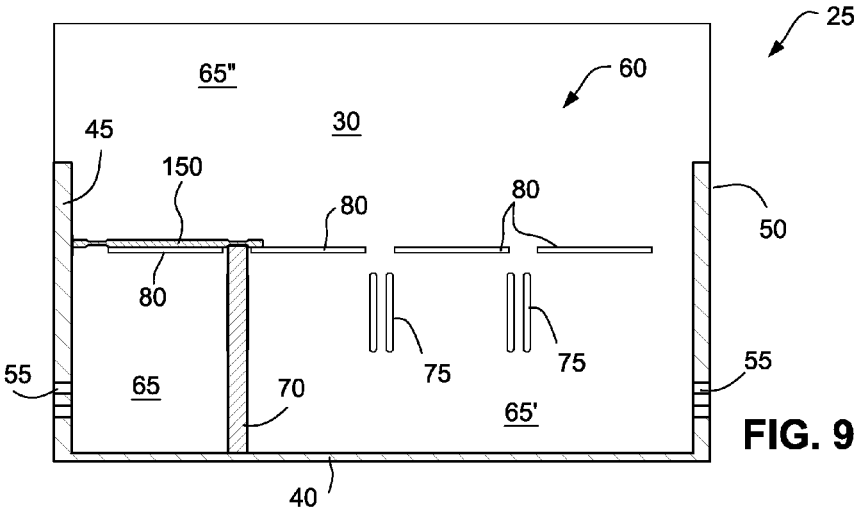
FIG. 9 is a cross-sectional view taken along line 9-9 of FIG. 8.

FIGS. 8 and 9 illustrate another configuration in which the organization system 60 includes a divider 150 with a plurality of grooves 155 that are sized to receive a portion of another divider 150 or divider 70. In this configuration, a horizontally oriented divider 70 or 150 may be supported by the horizontal support devices 80 and a vertically oriented divider 70 or 150. In addition, all of the dividers may be dividers 70 or dividers 150 or some combination of both. Also, dividers 70 and 150 may be interchangeable. Furthermore, because the vertically oriented dividers 70 and/or 150 may support the horizontally oriented dividers 70 and/or 150, the horizontal support devices 80 may be omitted.

Figure 10:
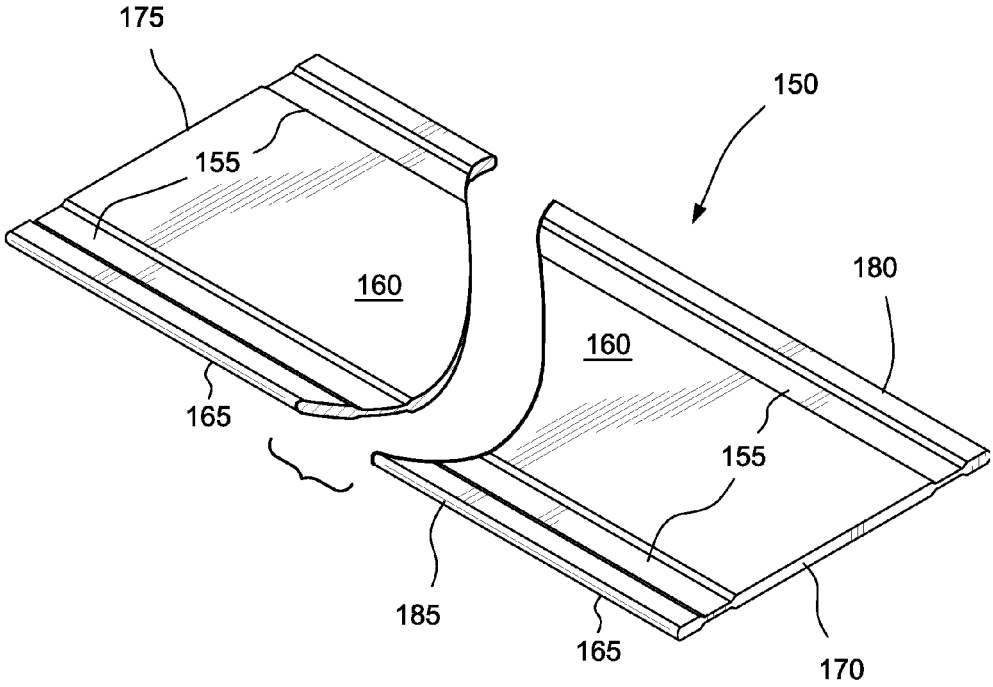
FIG. 10 is an illustration of an exemplary divider used in the compartmentalized container of FIGS. 8 and 9.

FIG. 10 is a perspective view of the divider 150, with grooves 155 in a first face 160 and a second face 165. The grooves 155 may run parallel to each other and may extend from a first end 170 to a second end 175. Although FIG. 10 illustrates the divider 150 without tongues at the first and second ends 170, 175, the divider 150 may have tongues at the first and second ends 170, 175 similar to the first and second tongues 110, 120 of the divider 70. In addition, the grooves 155 may be sized to receive either a side face 180 or a side face 185 of another divider 150 (or a side face 95 or 100 of a divider 70) to minimize or prevent lateral movement of the divider 150. Furthermore, similar to the divider 70, the divider 150 may be formed from any material such as, for example, extruded aluminum, plastic, etc. In addition, the divider 150 may have an anodized finish.

FIGS. 2, 3, 8 and 9 illustrate a method for dividing the container 25 into multiple compartments 65. To form laterally adjacent compartments 65 and 65', a vertically oriented divider 70 (or divider 150) may be lowered into the container 25. While the divider 70 (or divider 150) is lowered into the container 25, the first tongue 110 (the first end 105 if the first tongue 110 is omitted) may slide into the receiving space 145 of a first vertical support device 75 situated on a wall of the container 25. At the same time, the second tongue 120 (the second end 115 if the second tongue 120 is omitted) may slide into the receiving space 145 of a second vertical support device 75 attached to an opposing wall of the container 25.

For recessed vertical support devices 75 that do not extend the entire height of the associated wall, the vertically oriented divider 70 (or divider 150) may be warped (i.e., bent at the middle of the divider 70 or 150) so that the length of the divider 70 (or divider 150) is less than a distance between opposing vertical support devices 75. Next, the divider 70 (or divider 150) may be aligned with the vertical support devices 75. Next, the divider 70 (or divider 150) may be straightened (or permitted to go back to its original shape) wherein, the first and second tongues 110, 120 (or the first and second ends 105, 115) may be inserted into the recesses of the recessed vertical support devices 75. If the divider 70 (or divider 150) is made from rigid material that cannot be warped, the divider 70 (or divider 150) may be inserted into the vertical support devices 75 at the time the container 25 is manufactured.

To form vertically adjacent compartments 65 and 65", a horizontally oriented divider 70 (or divider 150) may be lowered into the container 25. For pairs of horizontal support devices 80 in which opposing horizontal support devices 80 have protrusions 147, the first tongue 110 (or the first end 105) may be placed on top of the protrusion 147 of one first horizontal support device 80 situated on a wall of the container 25. At the same time, the second tongue 120 (or the second end 115) may be placed on top of protrusion 147 of the other horizontal support device 80 attached to an opposing wall of the container 25.

For pairs of horizontal support devices 80 in which one horizontal support device 80 is recessed and the other horizontal support device 80 includes a protrusion 147, the first tongue 110 (or the first end 105) may be inserted into the recess before the second tongue 120 (or the second end 115) is placed on top of the protrusion 147.

For pairs of horizontal support devices 80 that include only recessed horizontal support devices 80, the horizontally oriented divider 70 (or divider 150) may be warped (i.e., bent at the middle of the divider 70 or 150) so that the length of the divider 70 (or divider 150) is less than a distance between opposing horizontal support devices 80. Next, the divider 70 (or divider 150) may be aligned with the horizontal support devices 80. Next, the divider 70 (or divider 150) may be straightened (or permitted to go back to its original shape) wherein, the first and second tongues 110, 120 (or the first and second ends 105, 115) may be inserted into the recesses of the recessed horizontal support devices 80. If the divider 70 (or divider 150) is made from rigid material that cannot be warped, the divider 70 (or divider 150) may be inserted into the horizontal support devices 80 at the time the container 25 is manufactured.

Figure 11:
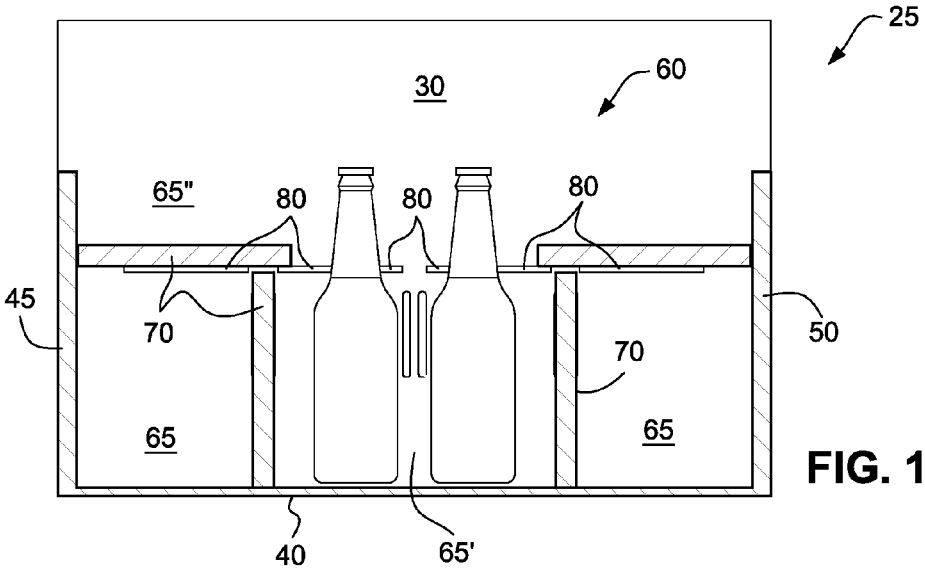
FIG. 11 is a cross-sectional view of the container of FIG. 2 with a different configuration of dividers.
Figure 12:
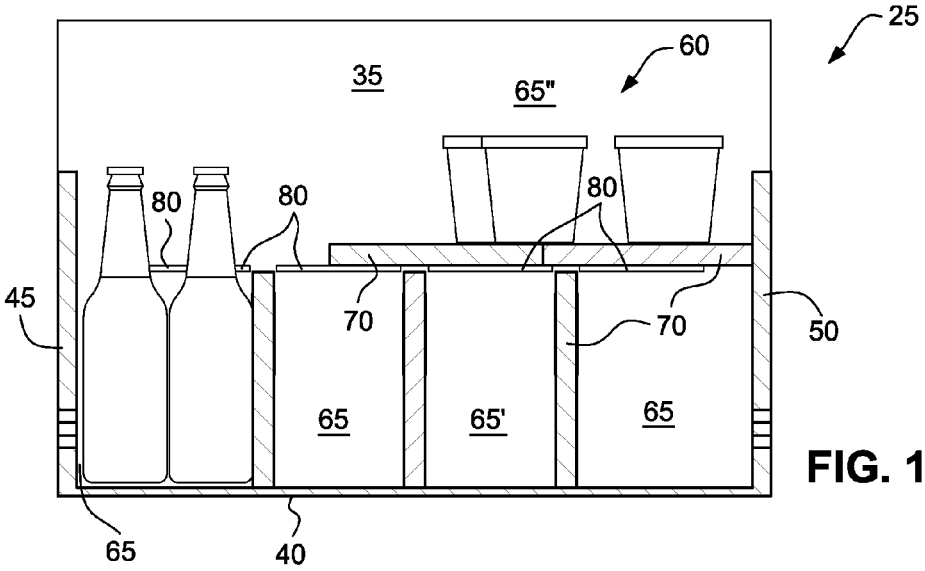
FIG. 12 is a cross-sectional view of the container of FIG. 2 with a different configuration of dividers.
Figure 13:
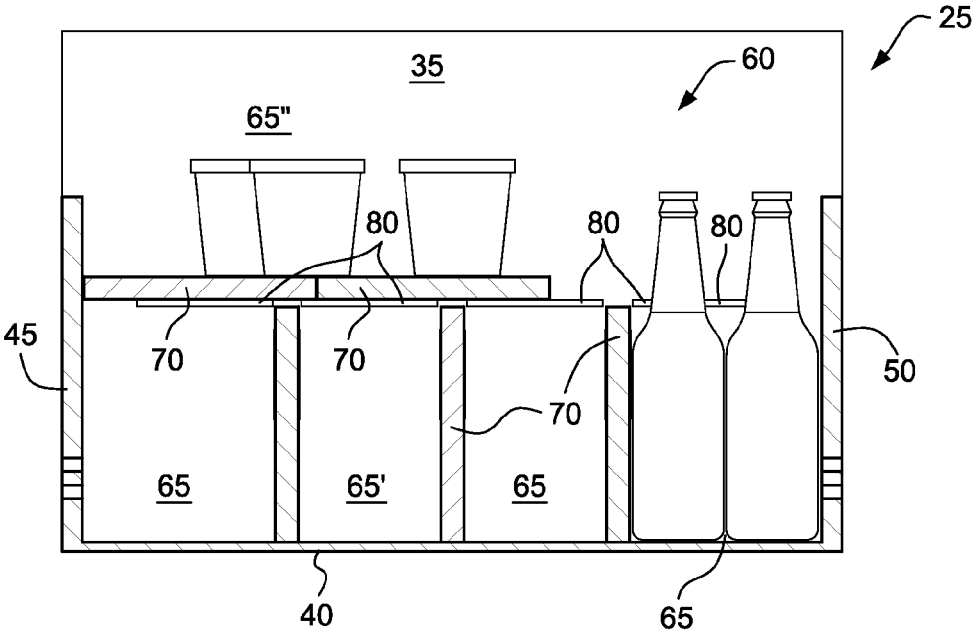
FIG. 13 is a cross-sectional view of the container of FIG. 2 with a different configuration of dividers.

After being inserted in or situated on top of a horizontal support device 80, the divider 70 (or divider 150) may be slid to any location that may result in a desired configuration such as the exemplary configurations disclosed in FIGS. 11-13. In FIG. 11, the horizontally oriented dividers 70 are slid against opposing side walls 45 and 50. In FIG. 12, the horizontally oriented dividers 70 are slid against the sidewall 50 to form a shelf that extends across dividers 70. In FIG. 13, the horizontally oriented dividers 70 are slid against the sidewall 45 to form another shelf that extends across two dividers 70.

If a vertically oriented divider 70 (or divider 150) has already been positioned below a location at which the horizontally oriented divider 70 (or divider 150) will be placed, the horizontally oriented divider 70 (or divider 150) may be lowered until it rests on an upper edge of the vertically oriented divider 70 (or divider 150). For horizontally oriented dividers 150, one of the grooves 155 of the horizontally oriented divider 150 may be aligned with an upper edge of the vertically oriented divider 70 (or divider 150) so that the groove 155 may receive the upper edge of the vertically oriented divider 70 (or divider 150) when the horizontally oriented divider 150 rests on the vertically oriented divider 70 (or divider 150). In this position, the grooves 155 may restrict or prevent a sliding movement of the horizontally oriented dividers 150 across the vertically oriented divider 70 (or divider 150). As can be seen from the exemplary aspects of the disclosed technology, the versatility of the organization system 60 may be increased while utilizing a limited number of components.

While the technology has been described in connection with what are presently considered to be the most practical and preferred examples, it is to be understood that the technology is not to be limited to the disclosed examples, but on the contrary, is intended to cover various modifications and equivalent arrangements included within the spirit and scope of the disclosure.

What is claimed is:

1. A system for dividing a kitchen appliance container into compartments, the system comprising:

a first divider that divides the container into compartments;

a first support device configured to removably receive and support the first divider in a first orientation that forms laterally adjacent compartments; and a second support device configured to removably receive and support the first divider in a second orientation that forms vertically adjacent compartments, wherein the first divider is configured to be selectively received by the first and second support devices, wherein when received by the first support device, the first divider is in position to permit a second divider with substantially the same dimensions as the first divider to slide over the first divider, wherein when received by the second support device, the first divider is horizontally slidable without interference from the first support device, and the second support device has a continuous horizontally extending surface long enough to prevent the first divider from falling over in a sliding direction while the first divider is being slid on the second support device.

2. The system of claim 1, wherein the first support device comprises:

a first pair of guides extending in a vertical direction and positioned on a first side wall; and a second pair of guides extending in a vertical direction and positioned on a second side wall that opposes the first side wall.

3. The system of claim 2, wherein the second support device comprises:

a first guide extending in a horizontal direction and positioned on the first side wall; and a second guide extending in a horizontal direction and positioned on the second side wall.

4. The system of claim 3, wherein the first divider includes a tongue on each end configured to be received in the first support device and configured to be received by the second support device, the tongue having a smaller thickness than the rest of the first divider.

5. The system of claim 3, further comprising the second divider, the second divider supporting the first divider when the second support device receives the first divider to form vertically adjacent compartments and the second divider is received by the first support device.

6. The system of claim 5, wherein the first and second dividers are interchangeable.

7. The system of claim 6, wherein the first divider includes a groove along an entire length of the first divider.

8. The system of claim 7, wherein a top portion of the second divider is received in the groove and prevents a lateral movement of the first divider.

9. The system of claim 5, wherein both the first support device and the second support device are configured to receive both the first divider and the second divider.

10. The system of claim 3, wherein the second support device comprises multiple first guides positioned on an interior face of the first side wall and multiple second guides positioned on an interior face of the second side wall, each of the first and second guides being positioned at the same height.

11. The system of claim 10, wherein the first support device comprises multiple first pairs of guides and second pairs of guides, each of the first and second pairs of guides of the first support device being aligned with gaps between the first and second guides of the second support device.

12. The system of claim 11, wherein the first divider is configured to slide across the multiple guides of the second support device.

13. The system of claim 11, wherein the first divider is configured to span across multiple guides of the second support device.

14. The system of claim 11, wherein each of the first and second guides of the second support device are configured to support multiple first dividers.

15. The system of claim 3, wherein the first divider is configured to stably overhang the first and second guides when supported by the second support device.

16. The system of claim 2, wherein the first pair of guides are integral to the container.

17. The system of claim 2, wherein the first pair of guides are removable.

18. The system of claim 1, wherein the first support device comprises:

a first recess extending in a vertical direction and positioned on a first side wall; and a second recess extending in a vertical direction and positioned on a second side wall that opposes the first side wall.

19. The system of claim 18, wherein the second support device comprises:

a third recess extending in a horizontal direction and positioned on the first side wall; and a fourth recess extending in a horizontal direction and positioned on the second side wall.

20. The system of claim 19 further comprising a second divider that is interchangeable with the first divider.

21. The system of claim 20, wherein the first divider includes a groove along an entire length of the first divider.

22. The system of claim 21, wherein a top portion of the second divider is received in the groove and prevents a lateral movement of the first divider.

23. The system of claim 1, wherein the first divider comprises first and second ends configured to be received by the first support device and configured to be received by the second support device.

24. The system of claim 1, the first support device is configured to removably receive and support the first divider only when the first divider is in the first orientation, and the second support device is configured to removably receive and support the first divider only when the first divider is in the second orientation.

25. The system of claim 1, wherein a top of the first support device is below a top of the second support device.

26. The system of claim 1, wherein the first support device is positioned below a horizontal plane along which the first divider slides on the second support device.

27. The system of claim 1, wherein the first support device is one of a plurality of first support devices and the second support device constitutes a horizontal rib or flange placed between said first support devices.

28. The system of claim 1, wherein the continuous horizontally extending surface is elongate in the sliding direction.

29. The system of claim 1, wherein when the first divider is received by the first support device, the first divider is in position to directly support the second divider.

30. A method for dividing a kitchen appliance container into compartments, the method comprising:

forming laterally adjacent compartments by inserting a first divider into a first support device; and forming vertically adjacent compartments by placing a second divider on a second support device, wherein the first and second dividers are interchangeable, and the first and second dividers are slidable across the kitchen appliance container when supported by the second support device, wherein the second support device provides a continuous horizontally extending surface long enough to prevent the first and second dividers from falling over in a sliding direction when the first and second dividers are slid across the kitchen appliance container.

31. The method of claim 30, wherein the first support device comprises:

a first pair of guides extending in a vertical direction and positioned on a first side wall; and a second pair of guides extending in a vertical direction and positioned on a second side wall that opposes the first side wall.

32. The method of claim 31, wherein the second support device comprises:

a first guide extending in a horizontal direction and positioned on the first side wall; and a second guide extending in a horizontal direction and positioned on the second side wall.

33. The method of claim 30, wherein the first support device comprises:

a first recess extending in a vertical direction and positioned on a first side wall; and a second recess extending in a vertical direction and positioned on a second side wall that opposes the first side wall.

34. The method of claim 33, wherein the second support device comprises:

a third recess extending in a horizontal direction and positioned on the first side wall; and a fourth recess extending in a horizontal direction and positioned on the second side wall.

35. The method of claim 34, wherein the first divider is warped before being inserted in the first and second recesses and the first or second divider is warped before being inserted in the third and fourth recesses.

36. The method of claim 30, wherein the second divider includes a groove along an entire length of the second divider.

37. The method of claim 36, wherein a top portion of the first divider is received in the groove and prevents a lateral movement of the second divider.

38. The method of claim 30, wherein the second divider includes a tongue on each end configured to be received in the second support device, the tongue having a smaller thickness than the rest of the second divider.

39. The method of claim 30, wherein the first divider is horizontally slidable on the second support device without interference from the first support device.

40. The method of claim 39, wherein both the first support device and the second support device are configured to receive both the first divider and the second divider.

41. The method of claim 30, wherein the second divider has substantially the same dimensions as the first divider, and wherein the first divider is in position to directly support the second divider when the first divider is received by the first support device.

42. The method of claim 30, wherein the second divider has substantially the same dimensions as the first divider, and wherein the first divider is in position to permit the second divider to slide over the first divider when the first divider is received by the first support device.

43. A kitchen appliance comprising:

a container;

a first divider that divides the container into compartments;

a first support device configured to removably receive and support the first divider in a first orientation that forms laterally adjacent compartments; and a second support device configured to removably receive and support the first divider in a second orientation that forms vertically adjacent compartments, wherein both the first support device and the second support device are configured to receive the first divider, wherein when received by the first support device, the first divider is in position to directly support a second divider that has substantially the same dimensions as the first divider, and the second support device is configured to permit movement of the first divider within the container to create vertically adjacent compartments at different locations within the container when the second support device receives the first divider.

44. The kitchen appliance of claim 43, further comprising the second divider, the second divider being configured to be selectively received by the first and second support devices.

45. The kitchen appliance of claim 44, wherein the first and second dividers are interchangeable.

46. The kitchen appliance of claim 43, wherein the first divider comprises at least part of the second support device when the first divider is received by the first support device.

47. The kitchen appliance of claim 46, wherein the second support device is received in the first support device.

48. The kitchen appliance of claim 47, wherein the first and second dividers are interchangeable.

49. The kitchen appliance of claim 43, wherein the first divider is horizontally movable on the second support device without interference from the first support device.

50. The kitchen appliance of claim 43, wherein the second support device has a continuous horizontally extending surface long enough to prevent the first divider from falling over in a sliding direction while the first divider is being slid on the second support device.

51. The kitchen appliance of claim 43, wherein when received by the first support device, the first divider is in position to permit the second divider to slide over the first divider.

52. The kitchen appliance of claim 43, wherein when received by the first support device, the first divider is in position to cooperate with at least one of the second support device and a third divider to support the second divider so that a largest face of the second divider extends along a substantially horizontal plane.

* * * * *